United States Patent [19]

Ahmed

[11] Patent Number: 4,788,775

[45] Date of Patent: Dec. 6, 1988

[54] DRYERS AND CONTROL SYSTEMS THEREFOR

[75] Inventor: Mahboob Ahmed, Bothell, Wash.

[73] Assignee: HR, Incorporated, Bellevue, Wash.

[21] Appl. No.: 932,705

[22] Filed: Nov. 19, 1986

[51] Int. Cl.[4] ..... F26B 19/00

[52] U.S. Cl. ..... 34/48; 34/53; 34/54; 34/55

[58] Field of Search ..... 34/48, 54, 53, 44, 55

[56] References Cited

U.S. PATENT DOCUMENTS 3,818,604 6/1974 Offutt et al. .
4,083,118 4/1978 Cotton .
4,112,588 9/1978 Marcade .
4,206,552 6/1980 Pomerantz et al. .
4,231,166 11/1980 McMillan .
4,312,138 1/1982 Ellington .
4,372,054 2/1983 Pomerantz et al. .
4,397,101 8/1983 Rickard .
4,412,389 11/1983 Kruger .
4,418,271 10/1984 Smock .
4,477,982 11/1984 Cotton .
4,483,082 11/1984 Ellingson .
4,506,458 3/1985 Cochrane .
4,531,307 7/1985 Kuecker .

*Primary Examiner*—Henry A. Bennett
*Attorney, Agent, or Firm*—Hughes, Cassidy & Multer

[57] ABSTRACT

Dryers with a timed drying cycle of user selectable duration and a continuous drying cycle which is terminated only upon receipt of an input from the user of the dryer. An optional module allows the user to select the maximum temperature wanted in the dryer cabinet, the minimum temperature needed for effective drying is set at the factory. Control is exercised via a microprocessor over the heater and the fan of a heater/fan unit, a recirculating blower, and the blower of an optional HEPA filter assembly if that assembly is present.

15 Claims, 8 Drawing Sheets

DRYERS AND CONTROL SYSTEMS THEREFOR

TECHNICAL FIELD OF THE INVENTION

The present invention relates to dryers which are particularly suited for applications involving disinfection and/or sterilization methods which require drying and to novel improved systems for controlling the operation of such dryers.

Typical of the items which these novel dryers are particularly suited to dry are: corrugated tubing, bottles and jars, anesthesia bags, and small-bore tubing and capillaries.

BACKGROUND OF THE INVENTION

Dryers of the character described herein are typically used by hospitals and similar facilities to dry a variety of reusable items such as those identified in the preceding paragraph. The dryers heretofore available for such applications have a number of drawbacks such as a smaller than desirable capacity, uneven temperatures within the dryer cabinet, and a variety of mechanical deficiencies. Also, they generally have mechanical controls; do not offer a choice of drying cycles or drying temperatures; and lack features which would be useful to the user such as temperature and cycle time remaining readouts.

SUMMARY OF THE INVENTION

In contrast to those that have heretofore been commercially available, the novel dryers disclosed herein are adaptable to most methods of disinfection and/or sterilization requiring drying; and they have large capacities and are capable of providing many years of trouble-free operation with only a minimum of maintenance. Thus, they easily meet the stringent equipment reprocessing demands of such hospital departments as respiratory therapy, anesthesia, and central supply.

In general, these novel dryers include a cabinet typically equipped with one or more basket type shelves for the items being dried, a heater unit which has a fan or blower for circulating air through the cabinet and over the items being dried, a recirculating blower, and a system for controlling the operation of the heater, heater fan, and recirculating blower. Optionally, the dryer may be equipped with a HEPA (high energy particulate air) filter to capture small particles that might otherwise enter the dryer cabinet from the surrounding air and contaminate the contents of the dryer. HEPA filters, in this respect, have a minimum efficiency of 99.97+ percent in removing particles measuring 0.3 microns or larger from gases (usually air) in which the particles are entrained.

As indicated above, the novel dryers disclosed herein will also normally be equipped with a recirculating fan or blower. The recirculating fan has two functions. First, it increases the air flow around the items being dried, thereby raising the moisture evaporation rate and decreasing the drying time. Second, the recirculating fan continuously mixes the air in the dryer cabinet, minimizing thermal stratification. Such stratification is undesirable as it leads to uneven drying of the items in the dryer cabinet.

Another important feature of the novel dryers disclosed herein is the control systems with which they are equipped. These control systems provide both continuous and timed drying cycles. In the latter mode of operation, the timer which controls the duration of the drying cycle will not start unless the interior cabinet temperature has reached a nonadjustable minimum; and the timer will not decrement for the duration of any period in which the interior cabinet temperature is below that minimum or, as an option, below a second, operator adjustable minimum.

Another significant feature of this novel control system is recall time circuitry which allows a user to identify the duration of a timed drying cycle, either during the course of the cycle or after the cycle has been completed. This information is important in, for example, adjusting the length of a subsequent drying cycle if a current one proves too short to completely dry the items being processed.

THE PRIOR ART

Dryers and dryer control systems which resemble those disclosed herein to some remote extent are disclosed in the following U.S. Pat. Nos.: 3,818,604 issued June 25, 1974, to Offutt et al. for TERMINATION LOGIC AND OUTPUT SUPPRESSION FOR INTEGRATED CIRCUIT DRYER CONTROL; 4,083,118 issued Apr. 11, 1978, to Cotton for TIME-AND-TEMPERATURE DRYER CONTROL; 4,112,588 issued Sept. 12, 1978, to Marcade for DRIER APPLIANCE CONTROL; 4,206,552 issued June 10, 1980, to Pomerantz et al. for MEANS AND METHOD FOR CONTROLLING THE OPERATION OF A DRYING APPARATUS; 4,231,166 issued Nov. 4, 1980, to McMillan for AUTOMATIC CONTROL FOR A CLOTHES DRYER; 4,312,138 issued Jan. 26, 1982, to Ellington for CONTROL SYSTEM FOR FABRIC DRYING APPARATUS; 4,372,054 issued Feb. 8, 1983, to Pomerantz et al. for METHOD AND MEANS FOR PROGRAMMING THE OPERATION OF AN APPARATUS; 4,397,101 issued Aug. 9, 1983, to Rickard for AUTOMATIC DRYER CONTROL; 4,412,389 issued Nov. 1, 1983, to Krüger for METHOD OF AUTOMATICALLY CONTROLLING THE DRYING PROCESS IN A LAUNDRY-DRYING SYSTEM, AND EQUIPMENT FOR PERFORMING THE METHOD: 4,418,271 issued Nov. 29, 1983, to Smock for CONTROL SYSTEM INCLUDING A TIMING MECHANISM FOR DRYING APPARATUS; 4,477,982 issued Oct. 23, 1984, to Cotton for MICROCONTROLLER-BASED DRYER CONTROL; 4,483,082 issued Nov. 20, 1984, to Ellingson for SINGLE RELAY FOR MOTOR AND HEATER CONTROL; 4,506,458 issued Mar. 26, 1985, to Cochrane for CONTROL CIRCUIT FOR GAS HEATED APPLIANCE; and 4,531,307 issued July 30, 1985, to Kuecker for FABRIC DRYER CONTROL WITH CIRCUIT INTERRUPT.

The Offutt et al. dryer control system has an undesirable degree of complexity, a drawback avoided in the novel dryer control systems disclosed herein by employing a microprocessor. Furthermore, the Offutt et al. control system lacks such novel features of mine as a continuous drying cycle and continuously updated displays of cabinet temperature and the time remaining in a timed drying cycle. Furthermore, and equally significant, the Offutt et al. dryer and control system have no provision for varying the internal cabinet temperature; for recalling, during or after a timed drying cycle, the time for which the cycle was set; a recirculating fan for evening out the cabinet temperature; or provision for a HEPA filter. And no provision is made for delaying the timing of a drying cycle until the cabinet temperature reaches a preselected minimum and for interrupting the timing of the cycle for the durations of periods during which the cabinet temperature falls below that minimum.

Cotton '982 discloses a dryer control system which operates in a manner antithetical to my objectives as the timer employed in the patented system decrements only when the dryer heater is turned off, not when it is turned on. Other features such as continuously updated temperature and cycle time remaining readouts are also lacking as are a recirculating blower, provision for a HEPA filter, etc.

The Marcade dryer control system also lacks those above-enumerated and important features of the novel dryer control systems I have invented and disclosed herein. Marcade's system also has the disadvantage that its timer does not run while the dryer's heater is operating even though the temperature in the dryer cabinet may be high enough for effective drying. In applications like those of concern to me, this would waste energy and could unacceptably extend a timed drying cycle.

At first blush, the Pomerantz et al. '552 dryer control system does seem to resemble mine to the extent that it is capable of providing a time independent drying cycle. However, that cycle is not one in which the cycle continues until cancelled as mine is. As a consequence, the dryers in which the Pomerantz et al. '552 control is incorporated could not have the capabilities of the novel dryers disclosed herein.

Aside from the foregoing, the Pomerantz et al. '552 dryer control has the disadvantage that it possesses none of those novel significant features of my invention enumerated above in conjunction with the discussion of the Offutt et al. patent.

The McMillan patent is concerned with a clothes dryer control system in which the heat input to the controlled dryer is reduced and the air flow increased when the falling rate part of the drying cycle is reached. A microprocessor is employed in the McMillan system. Otherwise, that system and the dryer in which it is embodied are quite different from, and have none of the advantages of, the dryer and dryer control system disclosed and claimed herein.

As far as its relevance to the patentability of the inventions disclosed herein is concerned, Ellington is essentially a duplicate of Pomerantz et al. '552. Like those patentees, Ellington is concerned with a control system which provides two different drying cycles; but neither of these is a continuous cycle which requires cancellation to terminate it. Again, those significant, enumerated features which distinguish my dryers and dryer control systems from those disclosed in the prior art are lacking.

Yet another dryer control system which has selectable drying cycles is disclosed in Pomerantz et al. '054. One of these drying cycles is continuous and can be terminated only by cancellation of the cycle; but the Pomerantz et al. '054 control system does not have any of the other above-enumerated, distinguishing features of the dryers and dryer control systems disclosed herein.

Another microprocessor-based dryer control system is disclosed in Rickard. However, this microprocessor is not employed like mine is; and the result is that the Rickard control system does not have the advantages and attributes of mine.

Krüger discloses a dryer control system which is relatively simplistic in that only one option—drying until a desired degree of dryness is reached—is available to the user. The user cannot control the dryer cabinet temperature, and the Krüger control system also lacks the other important features of those I have invented.

Insofar as Smock is relevant to the inventions disclosed herein, it is because the Smock control system includes a timer which does not run until a desired temperature is reached and also does not run when a thermostat closes to apply heat to the appliance However, there is no indication of what temperature is being measured; the mechanism for controlling the timer is totally different; and the other features of my invention such as an adjustable dryer cabinet temperature, recall of the time selected for the drying cycle, a continuous drying cycle which can be terminated only by cancellation, etc. are lacking.

Cotton '982 is yet another prior art patent which is deemed relevant because it discloses a microprocessor-based dryer control. However, this microprocessor is apparently employed only to control a drying cycle which is terminated when the load in the dryer reaches a desired degree of dryness, a scheme neither employed in nor appropriate for the dryers disclosed herein.

Yet another microprocessor-based dryer control is the subject of the Ellingson patent cited above. However, that reference is essentially concerned only with relating the operation of the heater and tumbler drive motor of a clothes dryer. This is not pertinent to the present invention as no tumblers are employed in the novel dryers disclosed herein.

Insofar as it is pertinent to the patentability of the inventions disclosed herein, Cochrane is considered cumulative to Smock; and the comments above concerning that patent are considered equally applicable to Cochrane.

Finally, Kuecker is concerned with yet another microprocessor-based dryer control. Again, the reference is not considered relevant because the only use disclosed for the microprocessor is in a temperature monitoring circuit employing an oscillator to sense airflow temperature.

OBJECTS OF THE INVENTION

From the foregoing it will be apparent to the reader that one important and primary object of the present invention resides in the provision of novel, improved dryers which are particularly suited for use in hospitals and in other demanding applications.

A related, also important and primary object of the invention is the provision of novel, improved control systems for dryers of the character described in the preceding object.

Other also important but more specific objects of the invention reside in the provision of dryers as described in the preceding objects:

which are adaptable to a wide variety of sterilization and disinfection methods requiring a drying step;

which have a large capacity;

which are capable of providing many years of trouble-free service with only a minimum of maintenance;

which have a uniform cabinet temperature;

which, as an option, can be equipped with a HEPA filter.

Still other important objects of the invention reside in the provision of dryer control systems as described in the foregoing objects:

which provide both continuous and timed drying cycles;

in which, in conjunction with the preceding object, the cycle timer will not run until the cabinet temperature has reached a selected minimum and will not run for the durations of periods in which the cabinet temperature falls below that minimum;

which, as an option, allow a user to adjust the minimum temperature maintained in the dryer cabinet to a level above a preselected, irreducible minimum;

which allow a user to identify the duration of a timed drying cycle, either during the cycle or after the drying cycle is completed;

which have the capability of so independently controlling the operation of a heater incorporated in the dryer as to keep the interior dryer cabinet temperature from exceeding a preselected maximum;

which allow a user to cancel or terminate both the continuous and timed drying cycles at any point during those cycles.

Other important objects and features and additional advantages of my invention will be apparent to the reader from the foregoing and the appended claims and as the ensuing detailed description and discussion proceeds in conjunction with the accompanying drawing.

| FIG. | Sub-routine |
|---|---|
| 7 | Initialize |
| 8 | Timed Dry |
| 9 | Continuous Dry |
| 10 | Set Recall |
| 11 | Display Update |
| 12 | Temperature Control |
| 13 | Timer Update. |

DETAILED DESCRIPTION OF THE INVENTION

Figure 1:
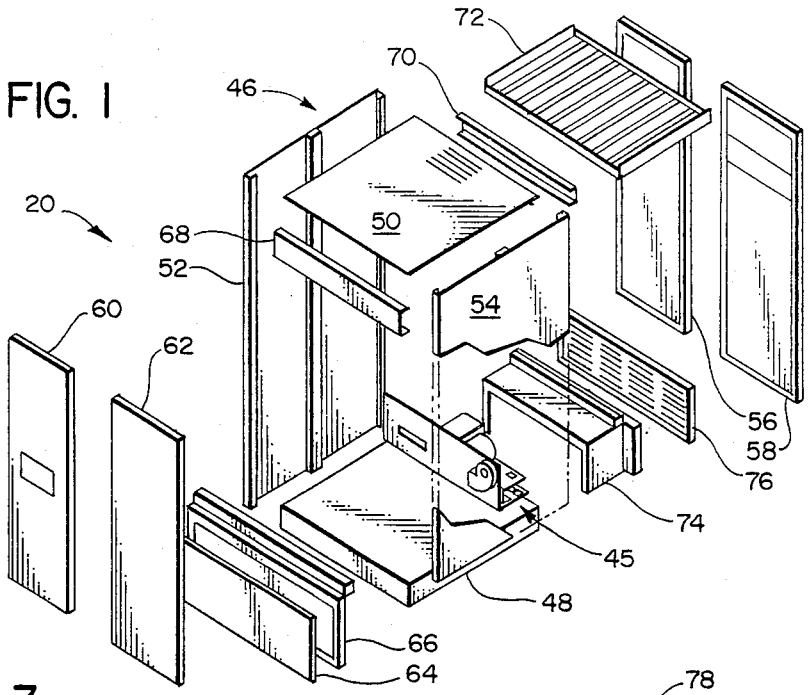
FIG. 1 is an exploded view of a dryer embodying, and constructed in accord with, the principles of the present invention.
Figure 4:
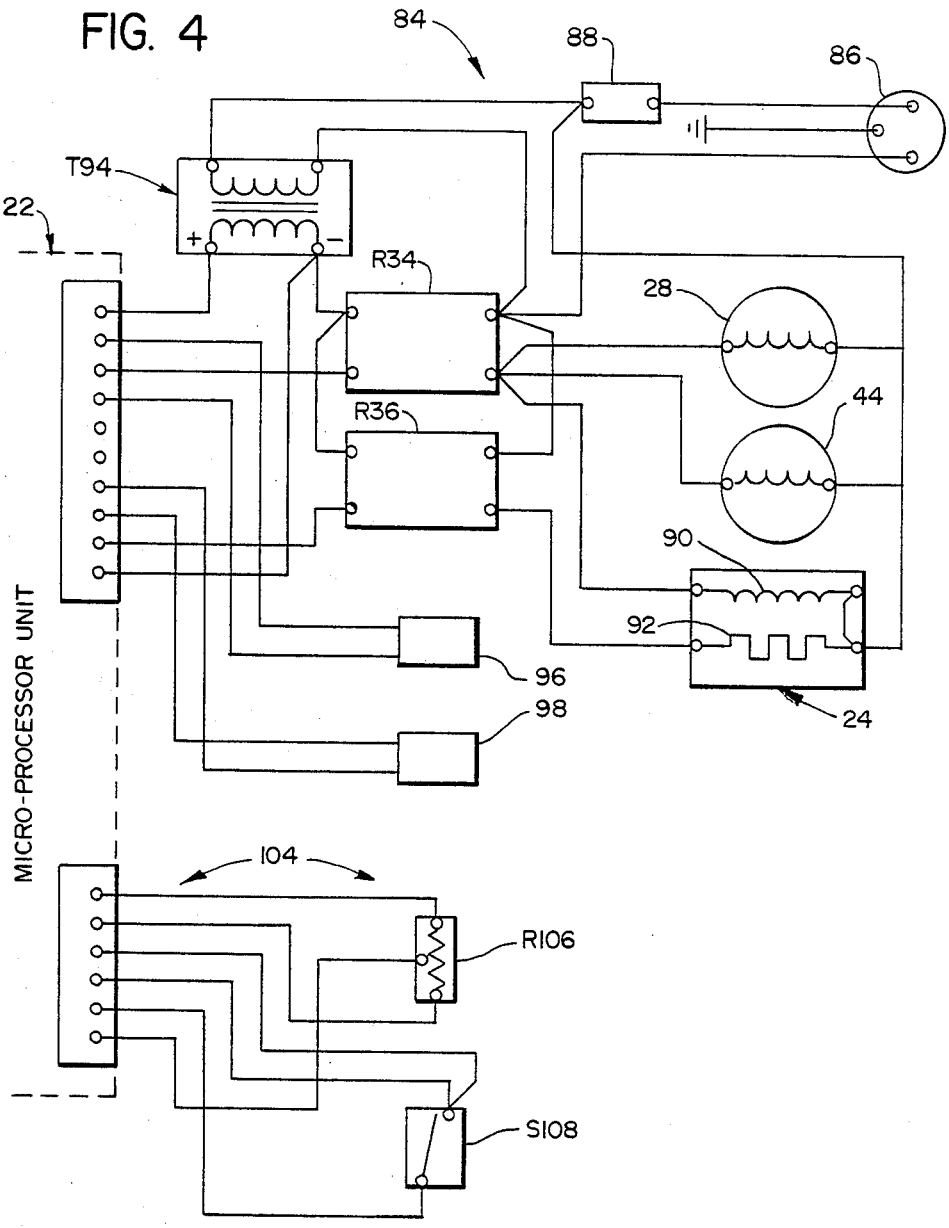
FIG. 4 is a wiring diagram for the dryer.

Referring now to the drawing, FIG. 1 depicts a dryer 20 which has a novel control system based on the microprocessor 22 illustrated in FIG. 4. A copy of the program which the microprocess rubs is attached as appendix A.

The microprocessor itself is not part of the present invention. It will accordingly not be described herein.

Figure 2:
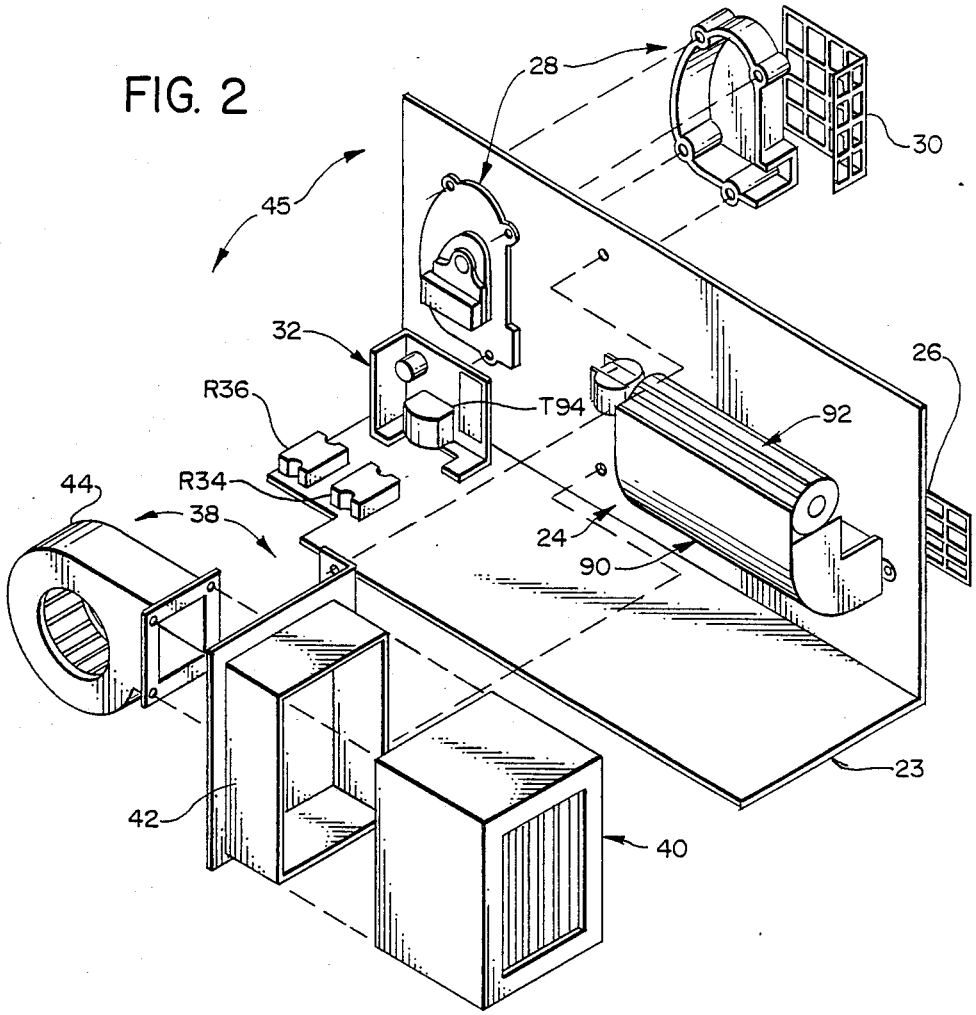
FIG. 2 is an exploded view of a chassis assembly and a HEPA filter assembly, both incorporated in the dryer shown in FIG. 1.

Referring now to both FIGS. 1 and 2 of the drawing, the major components of dryer 20 include a chassis 23 supporting: a heater/fan unit 24 with a grill 26, a recirculating blower 28 with a grill 30, a +5 volt power supply 32, two solid state relays R34 and R36, and a HEPA filter assembly 38 which includes the HEPA filter 40 per se and a bracket 42 for securing together the filter and a blower 44.

As discussed above, recirculating blower 28 is provided to promote more efficient drying and to prevent stratification of the heated air employed for convection drying in dryer 20. HEPA blower 44 is employed in conjunction with HEPA filter 40 to insure that only ultra-clean air is supplied to dryer 20 in applications where that is necessary or desirable.

The chassis assembly 45 made up of the components enumerated in the preceding paragraph is housed in a cabinet 46. That cabinet includes a base 48, a top wall panel 50, side wall panels 52 and 54, two rear wall panels 56 and 58, and two doors 60 and 62 which furnish access to the interior of the cabinet. Also part of cabinet 46 are structural members 64, 66, 68, and 70 to which the sheet metal components of the dryer cabinet are attached, an elastomer rack 72 for holding items being dried, a protective housing 74 for the components mounted on chassis 23, and an air intake grill 76.

Figure 5:
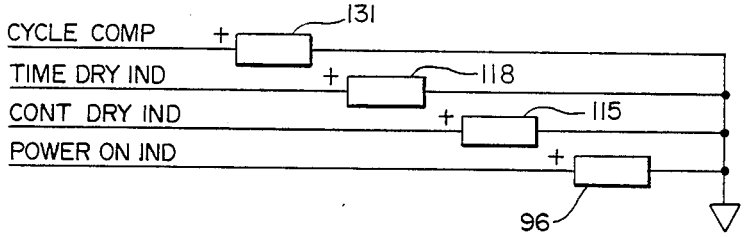
FIG. 5 is a wiring diagram for displays incorporated in the dryer to advise the user of: (a) the drying cycle option he has selected and (b) the operational status of the dryer.
Figure 6:
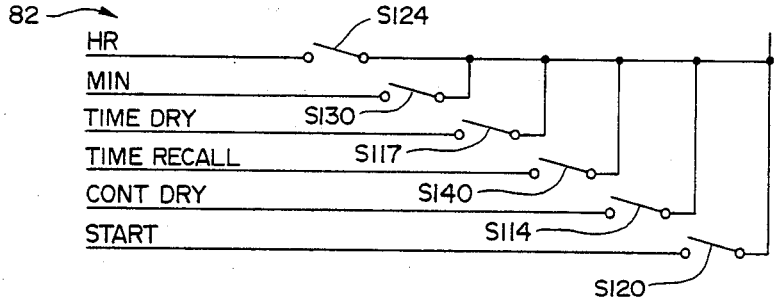
FIG. 6 is a wiring diagram for user-controllable switches incorporated in the dryer controls.

Turning next to FIGS. 3–7, the operation of heater/fan assembly 24, recirculating blower 28, and HEPA blower 44 are controlled by microprocessor 22. Instructions are inputted to microprocessor 22 by the user of the dryer via a control unit 78 mounted on the dryer cabinet. Microprocessor 22 is also connected to the several displays of control unit 78 illustrated in FIG. 5 and described hereinafter by the leads shown in that Figure, and the switching circuit 82 illustrated in FIG. 6 is employed to generate electrical pulses constituting user-initiated inputs to microprocessor 22.

Referring now specifically to FIG. 4 and the dryer circuit 84 therein depicted, dryer 20 is furnished with electrical power via a conventional 15 amp plug 86. One pin of that plug is connected to a terminal block 88, a second pin is grounded, and the third is connected in parallel to solid state relay R34 and to solid state relay R36. Relay R34 controls recirculating blower 28, HEPA blower 44, and the fan 90 of heater/fan unit 24; and relay R36 controls the operation of the heater 92 in fan/heater unit 24.

As shown in FIG. 4, solid state relays R34 and R36 are also connected to microprocessor 22. Consequently, when voltages appear at the appropriate output pins of the microprocessor, solid state relay R34 is activated to turn on recirculating blower 28, HEPA blower 44, and the fan 90 of heater/fan unit 24. In the same manner, solid state relay R36 is activated by microprocessor 22 to turn the heater 92 of unit 24 on and off.

A unit with both a heater and a fan is preferably employed in dryer 20 in the interest of making the drying operation as efficient as possible. Such units are commercially available, and the selection of an appropriate unit is well within the capabilities of those skilled in the arts to which this specification is addressed.

Referring still to FIG. 4, plug 86 is also connected through terminal block 88 to the primary of a conventional transformer T94 incorporated in power supply 32. The transformer secondary supplies a +5 volt operating voltage for microprocessor 22 and for solid state relays R34 and R36.

The remaining, illustrated components of circuit 84 are an in-use LED 96 and a temperature sensor 98.

LED 96 is turned on by microprocessor 22 while dryer 20 is running to show that the machine is in use.

Temperature sensor 98 is employed to control the operation of the heater 92 in heater/fan unit 24 by way of microprocessor 22. The temperature sensor is preferably mounted in the upper third of dryer cabinet 46 along one of the cabinet side wall panels 52 or 54. In such a location, the temperature reported by sensor 98 will best approximate the average interior dryer cabinet temperature.

Referring now primarily to FIGS. 3, 5, 6, and 7, the initial step taken by the user in operating dryer 20 is to connect the plug 86 shown in FIG. 4 to an appropriate, typically 110 volt, power source. This illuminates LED indicator 96 (FIGS. 3 and 4) and initializes microprocessor 22. At the same time, an internal interrupt timer in the microprocessor is set. That timer causes the program running in microprocessor 22 to be interrupted to update the time and temperature displays 100 and 102 of control unit 78. In a typical application of the invention this is done once every 10 milliseconds.

Next, the temperature and timer displays are checked to make sure that they are functioning properly; and the numerals 888 are displayed if they are. Then, all of the indicators of control unit 78 are turned on so that the user of the dryer 20 can be assured that those indicators are also operating properly. Typically, the indicators will remain lit for approximately two seconds. Then the displays are blanked; and the dryer is checked to see if an optional control module affording control over the maximum temperature maintained in dryer cabinet 46 is available.

That auxiliary temperature control module is illustrated in FIG. 4 in which it is identified by reference character 104.

The auxiliary temperature control module contains a potentiometer R106 and a set switch S108, both connected to input pins of microprocessor 22. Switch S108 is closed to allow potentiometer R106 to be adjusted. It is then opened so that the temperature setting will not be affected if the potentiometer slider is thereafter inadvertently displaced.

The temperature to which the system is adjusted will appear in temperature display 102 while the switch S108 is closed. Once the switch is reopened, display 102 goes blank.

Figure 7:
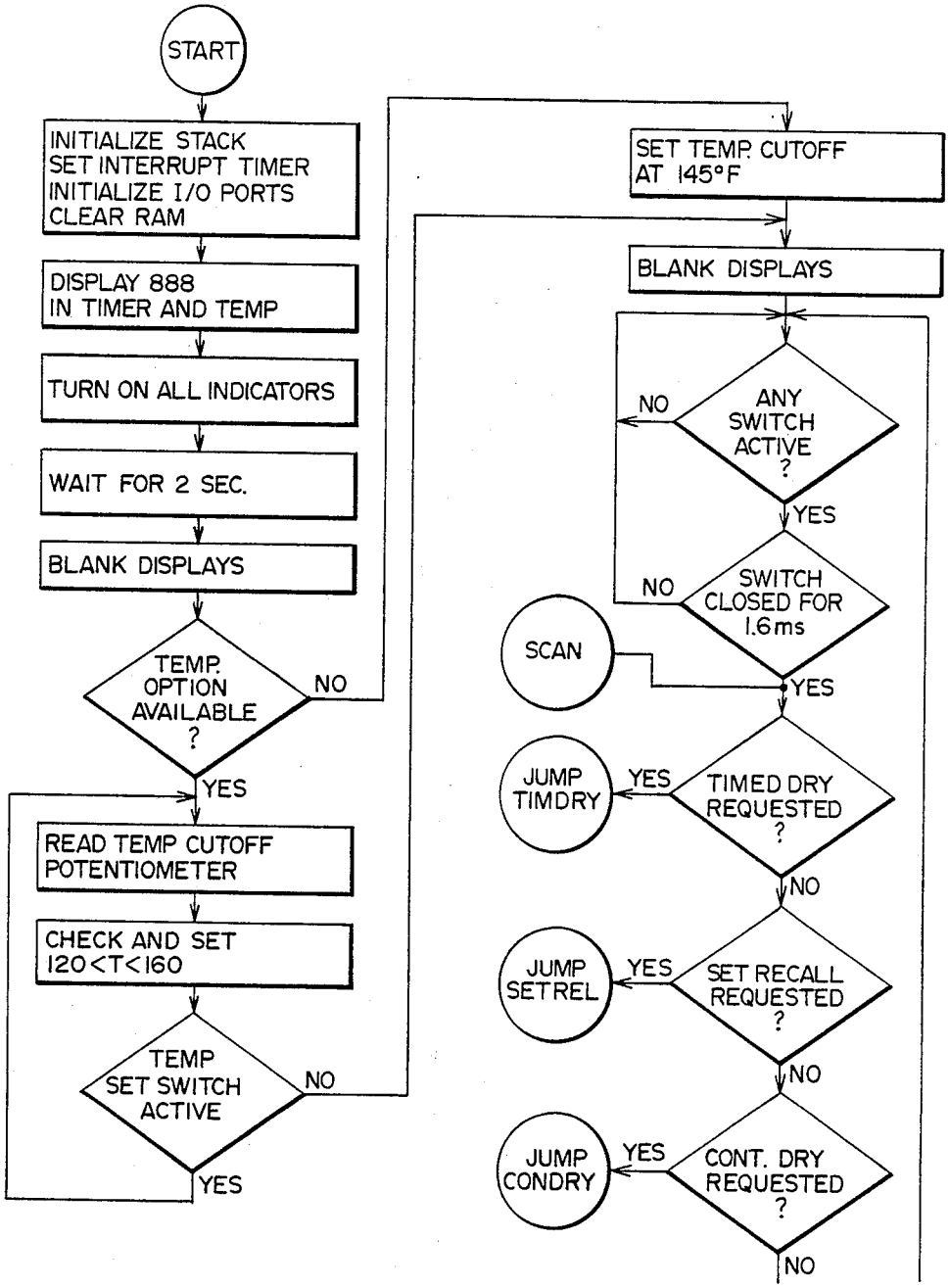
FIGS. 7–13 are flow charts of the control functions exercised by a microprocessor incorporated in the circuitry illustrated in FIG. 4 with the foregoing figures respectively illustrating the following sub-routines.

As indicated in FIG. 7, the interior cabinet temperature can be adjusted to a maximum temperature in the range of 120° to 160° F. if auxiliary temperature control module 104 is present. I have determined that this is the range which is most suitable to insure satisfactory drying of equipment such as that identified above without temperature-related damage to the equipment.

Figure 3:
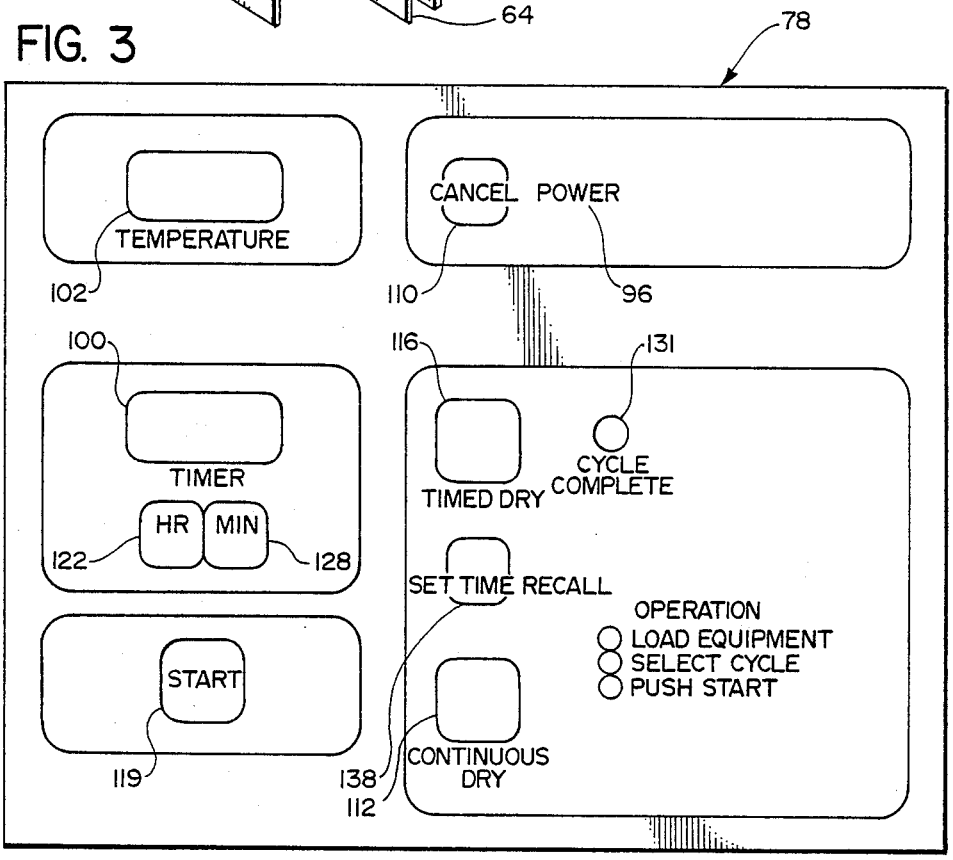
FIG. 3 is a pictorial representation of the dryer control panel.

Once the temperature has been set, it can be reset to a different level by closing switch S108 and pressing the pad 110 designated CANCEL on the control unit 78 depicted in FIG. 3. Pressing that pad causes microprocessor 22 to revert to the first step in the sequence illustrated in FIG. 7, and that sequence will be repeated as discussed above until the new temperature has been set and switch S108 again reopened.

Once the internal cabinet temperature has been decided upon, and switch S108 opened, microprocessor 22 causes all of the various displays of control unit 78 to go blank. The displays remain blank until either: (a) CONTINUOUS DRY pad 112 has been pressed to close switch S114 and select the continuous drying cycle, illuminating indicator 115 (see FIGS. 5 and 6), or (b) the TIMED DRY pad 116 has been pressed to close switch S117 and select a timed drying cycle, illuminating indicator 118.

In conjunction with the foregoing, microprocessor 22 is programmed to ascertain whether or not the selected cycle switch S117 or S118 has been kept closed by the user of the dryer for a minimum of, typically, 1.6 milliseconds. This is to insure that the selected switch has been legitimately closed by the user and that the pulse indicating the switch has been closed is not simply due to contact bounce or other spurious inputs.

Depending upon which drying cycle selection switch is closed, microprocessor 22 jumps to a sub-routine for carrying out a continuous drying cycle or one for carrying out a timed drying cycle. And, as is indicated in FIG. 7, set recall can also be requested. This results in the duration of a timed drying cycle being displayed, and that duration can be recalled either during or after the completion of a drying cycle.

Once a drying cycle has been selected, that cycle is initiated by pressing the pad 119 identified as START to close switch S120 (see FIG. 6).

Figure 8:
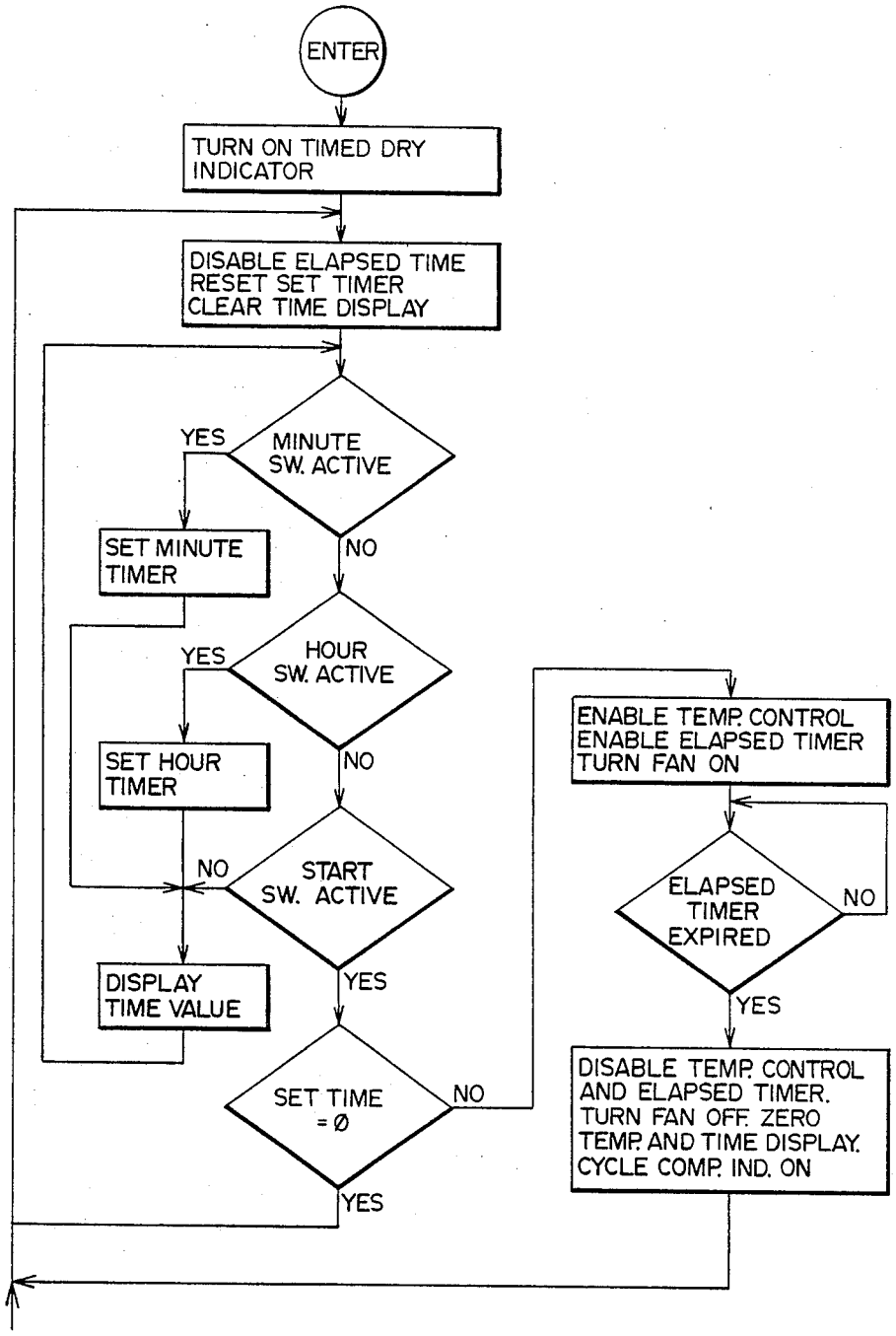

Referring again to the drawing, FIG. 8 depicts the sequence of events involved if the timed drying cycle has been selected. Initially, microprocessor 22 turns on the indicator 118 indicating that the timed drying cycle has been selected (see FIG. 5). Next, the timer circuits in the microprocessor are configured so that the user of dryer 20 can select the drying time. At this point, the time display 100 in unit 78 goes blank. That display remains blank until the user of the dryer: (a) presses HOURS pad 122 in control unit 78 to set the number of hours he wishes to have in the drying cycle by closing switch S124 (see FIG. 6), or (b) presses MINUTES pad 128 to close switch S130 and select the number of minutes wanted in the drying cycle.

Referring still to FIG. 8, when pad 128 is pressed to set the minutes in the internal microprocessor timer, the selected number of minutes is displayed in time display 100 of control unit 78. Similarly, if pad 122 has been pressed and thereby closed to set the hours in the timer, the number of hours is displayed in time display 100.

Next, microprocessor 22 checks to see whether START pad 119 has been pressed to close switch S120. If it has not, the microprocessor will continue looping through the timer setting steps just discussed; and the timer selected by the user of the dryer will continue to be displayed.

On the other hand, if the START pad has been pressed to close switch 120, the microprocessor will next check to insure that the set time—i.e., the time selected for the timed drying cycle—does not equal zero. For obvious reasons, one does not wish to operate dryer 20 through a cycle of zero time duration. Consequently, unless a drying cycle of finite duration has been selected, microprocessor 22 will cycle back to the point in the operating sequence where the setting of the minutes and hours timer is initiated.

Next, the microprocessor checks to see if: (a) the temperature in dryer cabinet 46 ascertained by temperature sensor 98 is above the 110° F. minimum needed for effective drying, and (b) the interior dryer temperature is below the 160° F. factory set maximum or below a user set maximum if auxiliary temperature module 104 is present.

If the internal dryer cabinet temperature is in the foregoing range, the microprocessor will enable its internal hours and minutes timer (not shown) and close relays R34 and R36. Closing those relays turns on the fan 90 and heater 92 of heater/fan unit 24, recirculating blower 28, and HEPA blower 44. These dryer components continue to operate until: (1) the internal cabinet temperature exceeds the maximum or cut-off level, (2) the temperature in the cabinet falls below the factory set or user selected minimum, or (3) the selected drying cycle time expires.

If the cut-off temperature is exceeded, heater 92 is turned off; and it remains off until the internal cabinet temperature again falls below the cut-off temperature.

If the internal cabinet temperature falls below the prescribed minimum, the internal hours and minutes timer of microprocessor 22 is disabled, but the heater 92 continues to operate to bring the internal cabinet temperature up to the selected minimum. At that point, the internal microprocessor timer is restarted. Thus, it is insured that the items being dried are in fact kept at a temperature equal to or above the factory set minimum for the user selected period of time.

In the third instance, in which the user selected time has elapsed, microprocessor turns off fan 90, blowers 28 and 44, and heater 92 and turns on a cycle complete indicator 131 (see FIG. 5). At this point, time display 100 will read 000 because the hours and minutes timer is of the decrementing type.

It was pointed out above that dryer 20 may be also operated in a continuous dry mode. In that mode, fan 90, blowers 28 and 44, and heater 92 are turned on when START pad 119 is pressed to close switch S120 following the pressing of pad 112 to select the continuous drying cycle. These dryer components remain turned on until CANCEL pad 110 is pressed by the user of the dryer to terminate the drying cycle.

There is one exception. If the internal dryer cabinet temperature ascertained by sensor 98 reaches the cut-off temperature, heater 92 is turned off until the internal temperature drops below the cut-off temperature and then turned back on. Fan 90 and blowers 28 and 44 continue to run while heater 92 is off.

The initial step performed by microprocessor 22 in the continuous drying mode (see FIG. 9) is to zero temperature display 102 which thereupon displays the numerals 000. Thereafter, the microprocessor checks to see if START pad 119 has been pressed to close switch S120. If it has, the microprocessor turns on heater/fan unit 24, recirculating blower 28, and HEPA blower 44 causing them to run continuously until CANCEL pad 110 is depressed to terminate the cycle as was discussed above or the cut-off temperature is reached in cabinet 46.

During the continuous drying cycle, the temperature in dryer cabinet 46 is available to the user of dryer 20 from temperature display 102. As was discussed, this display is updated once every ten milliseconds in a typical application of my invention.

Figure 9:
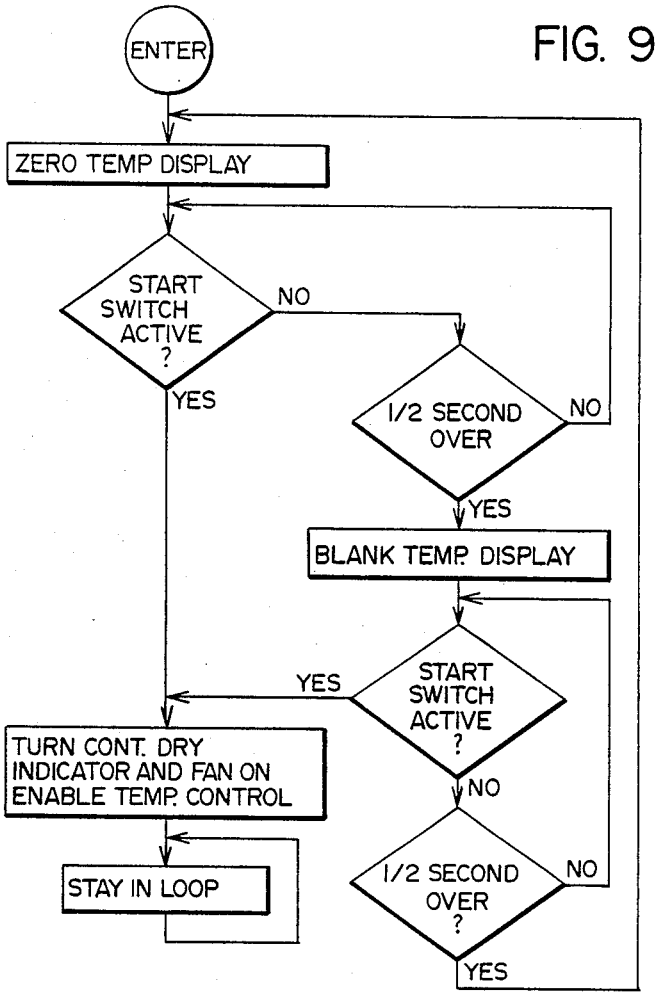

Referring still to FIG. 9, if start switch S120 has not been closed when its condition is checked by microprocessor 22, the microprocessor will cause the digit 000 displayed in temperature display 102 to blink. This indicates to the user of dryer 20 that he needs to press START pad 119 to initiate the continuous drying cycle.

While temperature display 102 blinks, microprocessor 22 continues to make a determination as to whether START switch S120 has been closed. If it has, heater/-fan unit 24, recirculating blower 28, and HEPA blower 44 will be enabled in the manner discussed above. On the other hand, if the START switch still has not been closed, the zero display in temperature display 102 will continue to blink on and off at 0.5 second intervals until the START pad is finally pressed and switch S120 closed.

Figure 10:
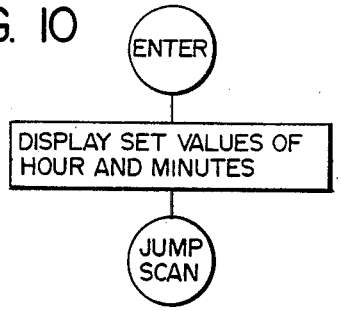

I also pointed out above that, during a timed drying cycle or after such a cycle has been completed, the user of dryer 20 may ascertain the length of time selected for the drying cycle. This is done by pressing SET RECALL pad 138 on control panel 78. That closes switch S140 (see FIG. 6), inputting an appropriate signal to microprocessor 22. Upon receipt of this signal, and as is shown in FIG. 10, the microprocessor responds by causing the selected drying cycle time to be displayed in time display 100. Then, the microprocessor jumps to SCAN (see FIG. 7), checking to see which, if any, of the switches S114, S117, and S140 have been closed. Thereafter, the microprocessor carries out the sequence discussed above which is appropriate for the closed switch.

Figure 11:
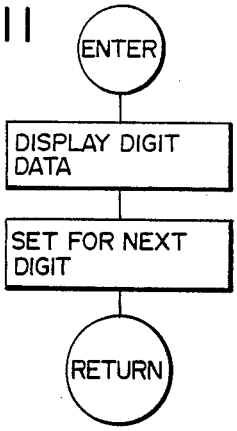
Figure 12:
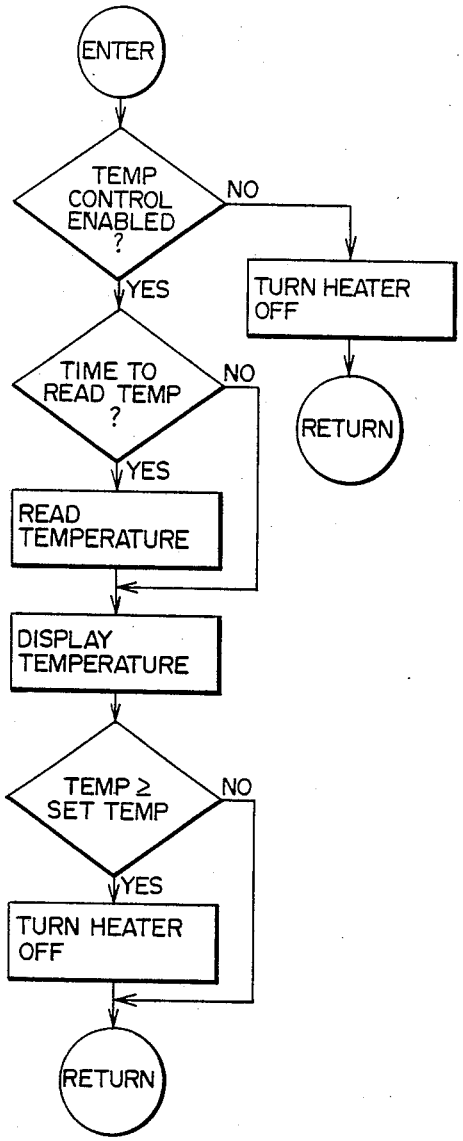

Referring still to the drawing, FIG. 11 depicts the sub-routine employed for updating the display of digits in temperature display 102 and in time display 100.

In order to conserve power, only one of a maximum of four digits in each of the two foregoing displays is displayed at any given time. Subsequent digits, however, are displayed with sufficient rapidity that, to the user of dryer 20, all involved digits up to the maximum of four appear to be displayed at all times.

As indicated in FIG. 11, the sequence carried out by microprocessor 22 in updating displays 100 and 102 is a simple one. It involves displaying one digit while recalling the value of the subsequent digit from memory, then displaying that recalled digit and so on.

Yet another routine is carried out by microprocessor 22 to control the internal temperature in dryer cabinet 46.

The temperature control is interrupt driven. That is, the program running in microprocessor 22 is periodically interrupted. When interrupted, the microprocessor retrieves stored data which may indicate that the internal temperature in cabinet 46 is too high, requiring that heater 92 be turned off. Or, if heater 92 is off, the retrieved data may indicate that the internal dryer cabinet temperature is low enough that the heater should be turned back on. As discussed above, this information is typically provided by microprocessor 22 at 10 millisecond intervals.

At the specified interval, microprocessor 22 ascertains whether temperature control is enabled. If not, microprocessor 22 will simply turn heater 92 off if it is then on and reenter the temperature control sub-routine.

If temperature control is enabled, the microprocessor will ascertain whether it is time to read the temperature in cabinet 46. If it is not, temperature display 102 will continue displaying the existent temperature. On the other hand, if the 10 millisecond interrupt interval has elapsed, the temperature data will be retrieved from microprocessor memory and read; and the new temperature will be displayed in display 102.

Also, if the newly displayed temperature exceeds the factory or user selected cut-off temperature, microprocessor 22 will turn heater 92 off. And, if the new temperature is below the cut-off limit, the microprocessor will instead leave heater 92 on and repeat the just-described temperature control sub-routine.

Another important function served by microprocessor 22, and discussed briefly above, is the updating of the time remaining in timed drying cycle. This function is also interrupt driven.

Figure 13:
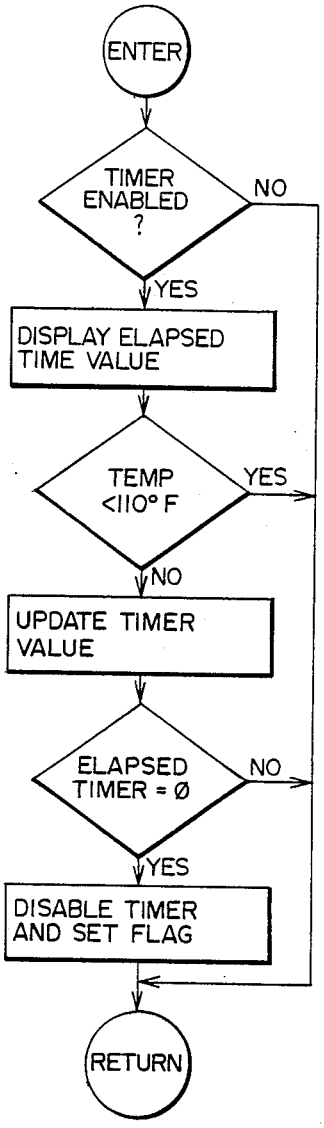

The steps taken by microprocessor 22 in updating the time in time display 100 are shown in FIG. 13.

First, microprocessor 22 determines whether or not its internal hours and minutes timer has been enabled by pressing the TIMED DRY pad 116 and then the START pad 119. If the timer has not thus been enabled, the microprocessor will simply loop back and reenter the sub-routine as shown in FIG. 13.

On the other hand, if the internal hours and minutes timer has been enabled, microprocessor 22 will cause the time remaining in the timed drying cycle to be displayed in time display 100.

Next, microprocessor 22 ascertains whether the internal temperature in dryer cabinet 46 is below the 110° F. minimum set at the factory and found necessary for effective drying. If the internal cabinet temperature is at or below the minimum, the timer will not decrement as discussed above. Instead, the microprocessor will again simply reenter the timer update sub-routine.

In contrast, if the internal cabinet temperature is above the 110° F. minimum, the hours and minutes timer will continue to run; and microprocessor 22 will update the time displayed in time display 100.

Next, the microprocessor will ascertain whether the hours and minutes timer has decremented to zero. If it hasn't, the microprocessor will loop back and repeat the steps just described.

If, instead, there is no time remaining in the drying cycle, microprocessor will disable its internal hours and minutes timer and set a flag. This results in the CYCLE COMPLETE indicator 131 being turned on.

As was discussed above, the program running in microprocessor 22 is periodically interrupted to update the temperature displayed in temperature display 102 and the remaining time displayed in time display 100. After completing the temperature update and timer update sub-routines, the main program is reentered and resumed from the point at which it is interrupted.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description. And all changes which come within the meaning and range of equivalency of the claims are therefore intended to be embraced therein.

What is claimed and desired to be secured by Letters Patent of the United States is:

1. A dryer which comprises the combination of a cabinet, means for effecting a flow of air through said cabinet, means for heating the air circulated through said cabinet, and control means for so controlling the operation of said air circulating means and said heating means that: (1) said air circulating means will be operated for an operator selected period of time beginning with the time at which the temperature in said cabinet reaches a minimum level, and (2) said heating means will be turned off only if the temperature in said cabinet reaches a selected maximum after it has once been turned on and only while said temperature is at or above said maximum, said control means comprising a timer and means which allows said timer to decrement only while the temperature in said cabinet is at or above said minimum level, thereby insuring that the temperature in said cabinet is at or above said minimum temperature for the period of time selected by the operator.

2. A dryer as defined in claim 1 in which said control means is operator adjustable to provide a second type of operating cycle in which said timer is overriden and said heating means and said air circulating means are operated continuously once said operator has initiated the operating cycle and until the operator terminates the operating cycle unless said maximum temperature is reached or exceeded.

3. A dryer as defined in claim 2 which includes display means and first and second operator-activatable means for respectively selecting and initiating said second type of operating cycle, said control means further comprising means for providing in said display means an indication that said second type of operating cycle has been selected but has not been initiated.

4. A dryer as defined in claim 2 wherein said control means includes means effective to: (a) cause said fan to be operated continuously during said second type of operating cycle, and (b) cycle said heater on and off only as necessary to keep the temperature in said cabinet from exceeding said selected maximum.

5. A dryer which comprises the combination of a cabinet; means for effecting a flow of air through said cabinet; means for heating the air circulated through said cabinet; control means providing a first, timed drying cycle and a second, continuous drying cycle; and means for supplying electrical power to said flow effecting means, said heating means, and said control means, said control means including an operator-activatable switch means for initiating and terminating said continuous drying cycle by respectively causing said flow effecting means and said air heating means to be turned on and turned off without interrupting the supply of power to said control means; means for overriding said operator-activatable means and turning off said air heating means while, but only for so long as, the temperature in the cabinet is above a selected maximum level; and timer means which is operated only during said first drying cycle and, during that cycle, only while the temperature in said cabinet is above a selected minimum level.

6. A dryer as defined in claim 1 which includes means for interrupting the operating cycle of the dryer and resetting the control means for selection of a new or a different drying cycle.

7. A dryer as defined in claim 1 which includes means for displaying the time remaining in a selected operating cycle and operator activated means effective during or after said selected operating cycle for causing said display means to show the selected total time of said operating cycle.

8. A dryer as defined in claim 1 which includes means automatically activated at the end of each timed drying cycled to indicate that the cycle is complete.

9. A dryer as defined in claim 1 which includes means for displaying the time remaining in the drying cycle and the temperature in said dryer cabinet and for continuously updating the displays of said time remaining and of said temperature.

10. A dryer as defined in claim 2 in which said control means comprises a microprocessor: (1) via which said operator can elect said second type of operator cycle, and (2) which is responsive to an input by said operator to terminate said second type of operating cycle.

11. A dryer which comprises the combination of a cabinet, means for effecting a flow of air through said cabinet, means for heating the air circulated through said cabinet, and control means providing a first, timed driving cycle and a second, continuous drying cycle, said control means including an operator-activatable means for terminating said continuous drying cycle; timer means which is operated only during said first drying cycle and, during that cycle, only while the temperature in said cabinet is above a selected minimum level; and means for interrupting the operating cycle of the dryer and resetting the control means for selection of a new or a different drying cycle.

12. A dryer which comprises the combination of a cabinet, means for effecting a flow of air through said cabinet, means for heating the air circulated through said cabinet, and control means providing a first, timed drying cycle and a second, continuous drying cycle, said control means including an operator-activatable means for terminating said continuous drying cycle; timer means which is operated only during said first drying cycle and, during that cycle, only while the temperature in said cabinet is above a selected minimum level; means for displaying the time remaining in a selected operating cycle; and operator activated means effective during or after said selected operating cycle for causing said display means to show the selected total time of said operating cycle.

13. A dryer which comprises the combination of a cabinet, means for effecting a flow of air through said cabinet, means for heating the air circulated through said cabinet, and control means providing a first, timed drying cycle and a second, continuous drying cycle, said control means including an operator-activatable means for terminating said continuous drying cycle; timer means which is operated only during said first drying cycle and, during that cycle, only while the temperature in said cabinet is above a selected minimum level; and means automatically activated at the end of each timed drying cycle to indicate that the cycle is complete.

14. A dryer as defined in claim 5 which includes means for displaying the time remaining in the drying cycle and the temperature in said dryer cabinet and for continuously updating the displays of said time remaining and of said temperature.

15. A dryer which comprises the combination of a cabinet; means for effecting a flow of air through said cabinet; means for heating the air circulated through said cabinet; and control means provided a first, timed drying cycle and a second, continuous drying cycle, said control means including: an operator-activatable means for initiating and terminating said continuous drying cycle by respectively causing said flow effecting means and said air heating means to be turned on and turned off; means for overriding said operator-activatable means and turning off said air heating means while, but only for so long as, the temperature in the cabinet is above a selected maximum level; timer means which is operated only during said first drying cycle and, during that cycle, only while the temperature in said cabinet is above a selected minimum level; means for selecting the continuous drying cycle; user-activatable means for initiating that cycle; a character display means; and means for causing the displayed characters to blink on and off if the user does not initiate the continuous drying cycle within a preselected period of time after selecting that cycle.

* * * * *